US008430471B2

(12) United States Patent
Cardells Tormo et al.

(10) Patent No.: US 8,430,471 B2
(45) Date of Patent: Apr. 30, 2013

(54) PRINTING HEAD ALIGNMENT ADJUSTMENT

(75) Inventors: Ana Maria Cardells Tormo, Barcelona (ES); Angel Martinez Barambio, Barcelona (ES); Marc Serra Vall, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 126 days.

(21) Appl. No.: 13/182,541

(22) Filed: Jul. 14, 2011

(65) Prior Publication Data

US 2013/0016147 A1 Jan. 17, 2013

(51) Int. Cl.
*B41J 29/38* (2006.01)

(52) U.S. Cl.
USPC ..... 347/14

(58) Field of Classification Search ..... None
See application file for complete search history.

(56) References Cited

U.S. PATENT DOCUMENTS

| | | | |
|---|---|---|---|
| 6,364,447 | B1 | 4/2002 | Boleda et al. |
| 7,121,642 | B2 | 10/2006 | Stoessel et al. |
| 7,581,799 | B2 | 9/2009 | Im et al. |
| 2004/0212650 | A1 | 10/2004 | King et al. |
| 2009/0027433 | A1 | 1/2009 | Van De Wynckel et al. |
| 2009/0096823 | A1 | 4/2009 | Watt et al. |

FOREIGN PATENT DOCUMENTS

| | | | |
|---|---|---|---|
| EP | 1201432 | A1 | 5/2002 |

*Primary Examiner* — Stephen Meier
*Assistant Examiner* — Tracey McMillion

(57) ABSTRACT

A method for automated alignment adjustment of a printing head includes determining a current drop velocity for the printing head based on a cumulative amount of ink that was dispensed by the printing head. An alignment adjustment on the printing head is performed to compensate for a change in the drop velocity based on the current drop velocity. A computer readable medium containing executable instructions and a system are also described.

20 Claims, 4 Drawing Sheets

PRINTING HEAD ALIGNMENT ADJUSTMENT

BACKGROUND

Latex inks have been developed for large format printing. A latex ink may provide a printed product with durability to sunlight and other environmental conditions. A latex ink may be water based, thus being more friendly to the environment than a solvent based alternative.

A typical printer enables an alignment adjustment of its printer heads so as to maximize printer quality. A typical alignment procedure includes printing a test pattern. A printed test pattern is examined to detect errors in printer head alignment. A misalignment of the printer head may be detected by examination of the printed test pattern. A controller that controls operation of the printer head may then compensate for the detected misalignment such that an acceptable image is printed on the substrate.

DETAILED DESCRIPTION

Automated printing head alignment adjustment, in accordance with an embodiment of the invention, may include performing an alignment adjustment of a printing head of a printer system. The printing head may be configured to dispense drops of ink such that the drops of ink are deposited at desired locations on a substrate surface. An actual location at which an ink drop is deposited may be affected by a velocity of the drops that are dispensed. The alignment adjustment may be based on compensating for a change in a drop velocity (from a previous value) based on a current drop velocity. The current drop velocity may be determined or derived from a cumulative amount of ink that was dispensed by that printing head. For the purpose of this description, the cumulative amount of ink is understood to refer a total amount (e.g. volume, mass, or weight) of ink that was dispensed by the printing head from the time that the printing head was installed until the current time (e.g. the time at which the cumulative amount is being measured, calculated, or otherwise obtained).

Typically, automated printing head alignment adjustment, in accordance with an embodiment of the present invention, may be applicable to inkjet printing with latex ink. Latex printing is typically associated with a large format printing system.

Figure 1:
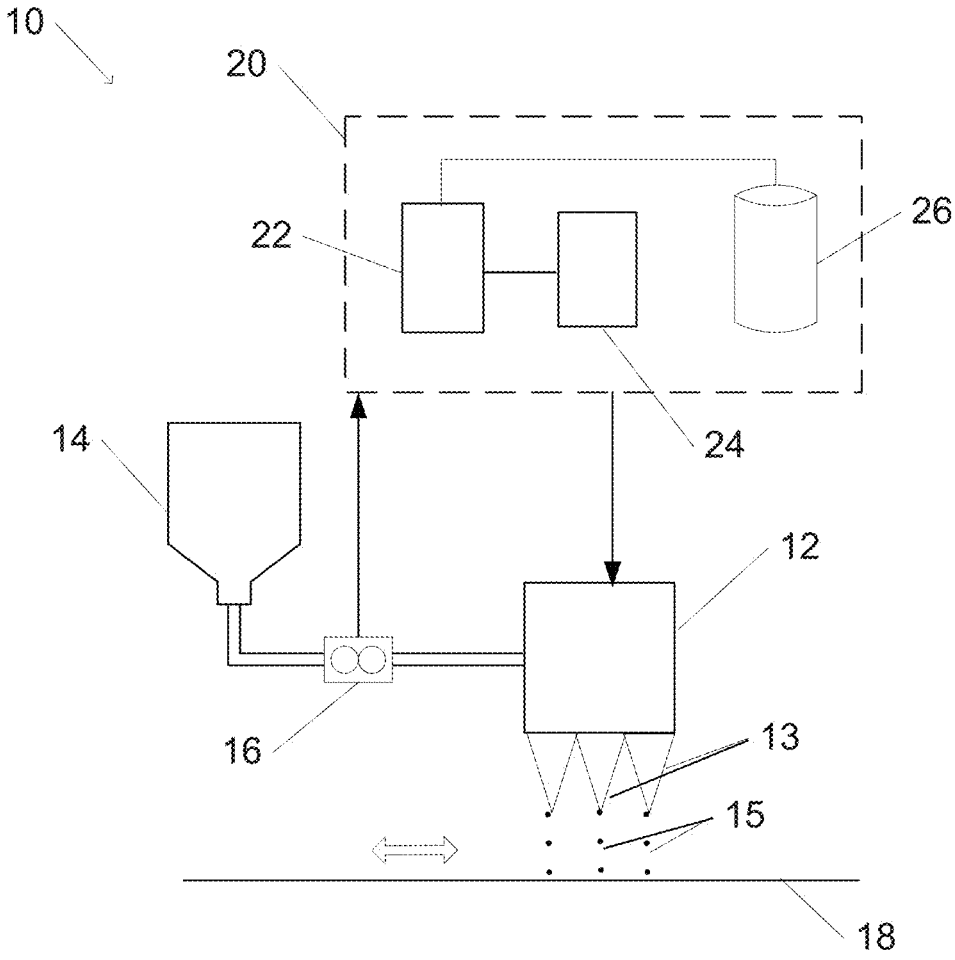
FIG. 1 is a schematic diagram of a printing system incorporating automated printing head alignment adjustment in accordance with an embodiment of the invention.

FIG. 1 is a schematic diagram of a printing system incorporating automated printing head alignment adjustment in accordance with an embodiment of the invention. Latex ink printing system 10 includes printing head 12. Printing head 12 is provided with ink from ink tank 14. For example, ink tank 14 may contain ink of a particular color or type.

Operation of printing head 12 is controlled by printer controller 20. Printer controller 20 may control printing head 12 to dispense ink jet 15 via nozzles 13. For example, ink drops of ink jets 15 that are dispensed by nozzles 13 may be deposited on substrate 18. Printer controller 20 may control motion of substrate 18, printing head 12, or both (e.g. in two perpendicular directions).

Printer controller 20 includes processor 22. Processor 22 may include a single processor, or two or more intercommunicating processors. Processor 22 or a component of processor 22 may include a computer or a processing component of a printer. Processor 22 is configured to operate in accordance with programmed instructions and with data provided. Processor 22 may communicate with memory unit 24 and with data storage device 26. For example, memory unit 24 may include a memory component of a computer of a printer. Memory unit 24 may be used to store programmed operating instructions or data for use in controlling printing head 12. Data storage device 26 may include one or more fixed or removable data storage devices. Data storage device 26 may include a non-volatile memory unit. Data storage unit 26 may store programming instructions for operation of processor 22. Data storage unit 26 may also store data required for operation of processor 22.

A quantity of ink that is provided by ink tank 14 and expelled by printing head 12 is measured. Measurement of a quantity of ink dispensed by printing head 12 via nozzles 13 is represented schematically by ink meter 16. Ink meter 16 may represent a combination of sensors, counters, and processors that together are capable of measuring a quantity of ink that is printed by printing head 12. For example, ink meter 16 may represent a counting (e.g. implemented in software or firmware) of a number of ink drops or pixels that are dispensed or printed, respectively, by printing head 12. As another example, ink meter 16 may represent a sensor that senses an amount (e.g. volume or weight) of ink that remains in ink tank 14. As another example, ink meter 16 may represent a sensor that senses a flow rate or quantity if ink that flows into printing head 12 or within printing head 12.

When printing with latex ink, a functional relationship may exist between drop velocity and the cumulative quantity of latex ink that was dispensed by the printing head since installation of the printing head in the printer system (or another event, e.g. thorough cleaning or refurbishing, that may restore the printing head to a state similar to a newly installed printer head). As latex ink is dispensed by the printing head over the useful installed life of the printing head, the drop velocity may change in a predictable manner. The drop velocity may be understood as referring to an average or other representative velocity of drops that are dispensed by the various nozzles of the printing head. Typically, drop velocity may decline approximately linearly as a function of a cumulative volume of latex ink that is dispensed by the printing head.

For a particular configuration of the latex printing system (parameterized, e.g., by a speed of relative motion between the printing head and substrate, and by a distance between the printing head and the substrate), an ink drop that is dispensed by the printing head may be deposited at a predictable location on the surface of the substrate. The alignment adjustment may be based on a calculated changes in drop deposition based on the functional relationship.

A functional relationship between drop velocity and a cumulative quantity of ink dispensed is known to occur when printing with latex ink by latex ink printing systems. However, a similar relationship between a characteristic property of ink deposition and the cumulative quantity of ink dispensed may be found for other types of inks or printing fluids. Therefore, references in this description to latex ink, latex ink printing, or to a latex ink printing system should be understood as referring to any ink, printing, or printing system, respectively, for which there exists a functional relationship between a cumulative quantity of ink that is dispensed by a printing head and a characteristic property of ink dispensing that predictably affects the predicted location of an ink drop that is deposited on a substrate.

Alignment adjustment typically may include an adjustment that is made in the manner in which the printing head is controlled so as to deposit ink on a substrate. Such alignment adjustment typically may include adjusting a timing or synchronization that determines when a nozzle, or group (e.g. a row, column, or region) of nozzles, of the printing head dispenses ink drops relative to other nozzles or other printing heads of the printing system.

For example, in a typical printing system, a substrate is moved past a printing head as the printing head dispenses a drop of ink. As part of printed content on the substrate, the drop may be intended to hit the substrate at a particular location relative to other drops that were deposited by other printing heads, or relative to an edge or other landmark on the substrate. If the drop velocity becomes slower than it was previously, in the absence of any alignment adjustment the drop may reach the substrate surface later than expected. As a result of the motion of the substrate, the drop may thus hit the substrate surface at a location that is displaced from the intended location. Deposition of ink drops at displaced locations may noticeably and adversely affect the printed product. In accordance with an embodiment of the invention, an alignment adjustment may enable compensating for such displacement of deposited ink drops, so as to obtain an acceptable printed product.

In accordance with an embodiment of the invention, the displacement may be calculable and predictable. Therefore, the manner of dispensing the drop may be adjusted (alignment adjustment) so as to compensate for the displacement that is due to the change in drop velocity. The alignment adjustment may enable the drop to hit the substrate surface at (or near to, as limited by the limitations of the printing system) the intended location. For example, the drop may be dispensed earlier than it would have been dispensed had the drop velocity not changed. Dispensing the drop earlier may thus enable the drop to be deposited at the intended location on the substrate surface. Thus, quality of a printed product may be maintained despite the change in drop velocity.

In some embodiments of the invention, if a printing system or printing head is so configured, an alignment adjustment may include adjusting a physical configuration of the printing system or printing heads. Such physical adjustment may include, for example, translating or reorienting a printing head or a nozzle or nozzles of the printing head, or adjustment of a (e.g. electrostatic or electromagnetic) drop aiming mechanism.

An alignment adjustment may typically be performed on a printer head when it is installed in a printing system. As part of the alignment adjustment, a test pattern may be printed on a substrate. The test pattern may be designed so as to indicate any deviation in relative alignment between one nozzle of the printing head and another, or of a nozzle relative to an expected alignment of that nozzle. For example, the pattern may be designed such that a nozzle or printing head that printed a particular portion of the test pattern may be readily identifiable. The printed test pattern may be imaged (e.g. by a scanner or by a camera) and the image analyzed so as to identify any deviations from alignment of a particular nozzle or printing head. Analysis of the image may indicate what initial alignment adjustments (e.g. timing or synchronization adjustments) may be made in order such that the printing system operates as desired. In some embodiments of the invention, the printed test pattern may be examined by a human operator by eye. The operator may then interact with the printing system in order to correct the alignment.

In the case of a typical latex ink printing system for printing with latex-based inks, the initial alignment may not remain valid throughout the lifetime of the printing head. For example, an ink drop velocity may slow over the course of the lifetime of the printing head affecting the location of deposition of a dot of ink on a substrate. Thus, additional alignment adjustments in accordance with an embodiment of the invention may be performed during the useful lifetime of the printing head.

When printing with an inkjet type printer, several factors may be taken into account when predicting a position on a substrate surface where a drop of ink is deposited to form a printed dot. Such factors may include, for example, the velocity (speed and direction of motion) of the drop as it is dispensed by a nozzle of a printing head, the relative motion between the printing head and the substrate, and the distance between the nozzle and the substrate. A change of drop velocity may thus affect the position of deposition of the dot. For example, the space between a printing head nozzle and a substrate surface in a latex ink printing system may be about 2 millimeters. A relative speed between the printing head and the substrate (e.g. caused by a motion of the substrate, the printing head, or both) may be about 40 inches per second (about one meter per second). The latex ink printing head may expel, or dispense, a drop of latex ink with a speed of about 9 meters per second (or about 12 m/s to 13 m/s for some types, e.g. colors, of latex ink) when the printing head is new, and about 6 meters per second when the printing head is near the end of its useful life (e.g. after having dispensed about 6 liters of latex ink). Thus, the change in drop dispensation speed over the course of the useful lifetime of the printing head may be predicted (on the basis of a simple kinematical calculation) to result in a difference between the location of the deposited drop and a desired location on the substrate surface. This difference between actual location of drop deposition on the substrate surface and a desired location is referred to as dot displacement error (DPE). In the example above, the DPE may change over the life of the printing head by about 0.2 millimeters. (For comparison, in a typical dye or pigment based printing system, a maximum allowed DPE is about 0.04 millimeters. Larger DPE may result in noticeable degradation of the printed image or pattern.) Therefore, an alignment adjustment to compensate for the change in DPE may be indicated.

The functional relationship of change of DPE (or drop velocity) with cumulative amount of ink dispensed may be different for different latex ink compositions (e.g. color or texture). In a typical printing system, multiple printing heads are provided where each printing head is limited to dispensing a particular type of ink. (For example, the ink may be provided in tanks that are connectable to the printing head. In this case, a printing system may be provided with mechanical or firmware barriers that prevent connecting a printing head to more than one type of ink tank.) A single printed line or pattern may be the result of depositing different types of latex ink on a single substrate. Thus, as a result of differential changes in DPE among the different types of latex ink (e.g. resulting from differential changes in drop velocity among the ink types) and in the absence of compensation for the differential changes, the appearance of the printed pattern could change its appearance over the lifetime of the printing head. Such a change in appearance could be noticeable to a person viewing the printed pattern, and would thus be unacceptable. Therefore, in accordance with an embodiment of the invention, a separate alignment adjustment may be applied to each printing head in accordance with the type of ink that is dispensed by that printing head so as to prevent any change in drop deposition location over the course of the lifetime of the printing head.

One solution would be to repeat the procedure of printing a test pattern, and realigning nozzles of the printing head based on the printed test pattern, at predetermined intervals. However, such a repetition may reduce the ease of use of the printing system. The amount of time and effort required to repeat an alignment procedure based on a printed test pattern during the lifetime of a printing head may be prohibitive to some users or potential users of the system.

Thus a solution that does not require printing a test pattern in order to perform an alignment correction may be convenient or attractive to a user of the printing system. Since a measurable functional relationship, or correlation, exists between drop velocity (or DPE) and the cumulative amount of ink that is expelled by a printing head, a correction may be calculated on the basis of this relationship. For example, the functional relationship may be measured under controlled conditions during product development or on sample systems during production.

A measurement or calculation of the cumulative amount (e.g. volume or mass) of ink that was dispensed by the printing head may be measured or calculated automatically.

For example, an amount of ink that is dispensed by a printing head may be measured in term of a cumulative count of the number of drops that were dispensed by the printing head (or of the number of pixels printed by the printing head). The amount stated in terms of drops (or pixels) may be converted to units of volume or mass by multiplying the cumulative number of drops by a representative (e.g. average) volume or mass of a dispensed ink drop. For example, a cumulative sum of drops or pixels may be stored in a data storage device that is associated with the printing system. The cumulative sum may be updated continuously during printing.

In some embodiments of the invention, a replaceable ink tank that provides ink to the printing head may be provided with a sensor that measures an amount (e.g. volume or weight) of ink that remains in the tank. For example, such a sensor may be provided with an ink tank for the purpose of sensing when the ink tank requires replacement. An amount of ink dispensed by the printing head from the ink tank may be deduced by subtracting the amount of remaining ink from the amount of ink in a full ink tank. This amount may be added to the amount of ink that was dispensed from previously replaced ink tanks, e.g. as stored by a data storage device that is associated with the printing system. For example, the amount of ink dispensed may be measured continuously during printing, at predetermined intervals, or upon the occurrence of one or more predetermined events (e.g. turning on the printing system, or beginning or finishing a printing job).

In some embodiments of the invention, a sensor (e.g. a flowmeter) may be provided for measuring an amount of ink, or a rate of ink dispensation, during printing by the printing head.

On the basis of a known functional relationship between the cumulative amount of ink expelled by a printing head and the drop velocity, a current DPE for each nozzle of printing head may be calculated. For example, a current DPE for each nozzle may be stored in a data storage device that is associated with the printing system. A current DPE for a printing head may be calculated whenever a stored value of a cumulative amount of ink dispensed is updated, or at predetermined intervals or upon the occurrence of one or more predetermined events.

The current DPE may be compared with the DPE at the time of the most recent alignment adjustment of the printing head. When the change in DPE or drop velocity so indicates, an automatic alignment adjustment procedure may be performed. Typically, an alignment adjustment includes adjusting a timing or synchronization of the time of dispensation of an ink drop from each nozzle of a printing head in order to compensate for the change in DPE. Factors that may affect indication of performance of alignment adjustment may include comparison of a change in DPE with a threshold value, as well as other factors such as current activity of the printing system or content of a queue of printing jobs to be executed.

By automatically performing alignment adjustment based on an amount of ink dispensed, printing quality may be maintained automatically over the lifetime of a printing head while minimizing impact on workflow. (For example, a typical alignment adjustment for a printing system with more than 12,000 nozzles divided among three printing heads may require about 40 seconds, during which time an appropriate message that informs the operators of the cause of the delay. This amount of time is in contrast to the approximately 10 minutes that are typically required for performing an alignment procedure that includes printing and analysis of test pattern.)

If one printing head of a printing system fails to deposit ink on a substrate surface at an intended location relative to ink deposited by another printing head of the printing system, a printed product may be affected in one or more ways. For example, a printed region may be darker or lighter than intended, or may contain bands of lighter or darker (or variously colored) regions. A printed line, curve, or band may appear to be broken.

Figure 2:
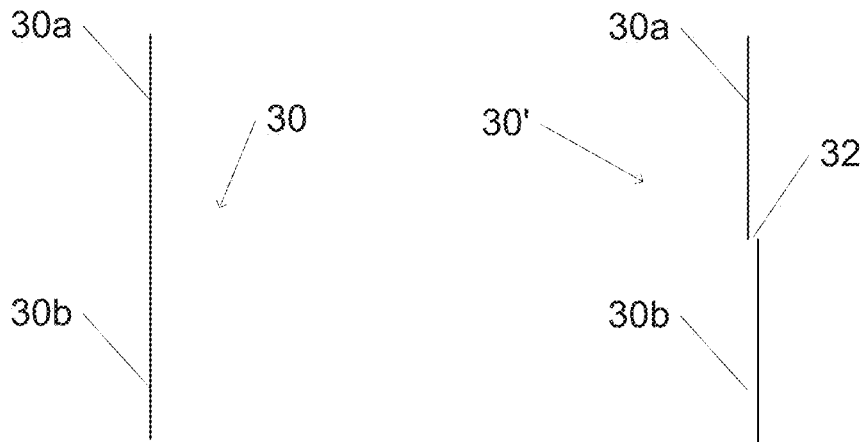
FIG. 2 illustrates an effect on a printed line of a change in ink deposition that is correctable by automated printing head alignment adjustment in accordance with an embodiment of the invention.

FIG. 2 illustrates an effect on a printed line of a change in ink deposition that is correctable by automated printing head alignment adjustment in accordance with an embodiment of the invention. Printed line 30 includes upper printed line segment 30*a* and lower printed line segment 30*b*. For example, upper printed line segment 30*a* may have been printed using one printing head, while lower printed line segment 30*b* was printed by another printing head. Relative motion between the printing heads and the substrate may have been approximately perpendicular to the orientation of printed line 30 (e.g. printing head motion from left to right).

The DPE of the printing head that printed upper printed line segment 30*a* may change (e.g. the drop velocity slows) relative to the DPE of the printing head that printing lower printed line segment 30*b* at gap 32. In this case, the result of printing a vertical line may resemble printed line 30'. In printed line 30', upper printed line segment 30*a* may be displaced (e.g. due to a slower drop velocity) relative to lower printed line segment 30*b* at gap 32. After performing automated printing head alignment adjustment, in accordance with an embodiment of the invention, the two printing lines are aligned such that a printed vertical would resemble printed line 30.

Figure 3:
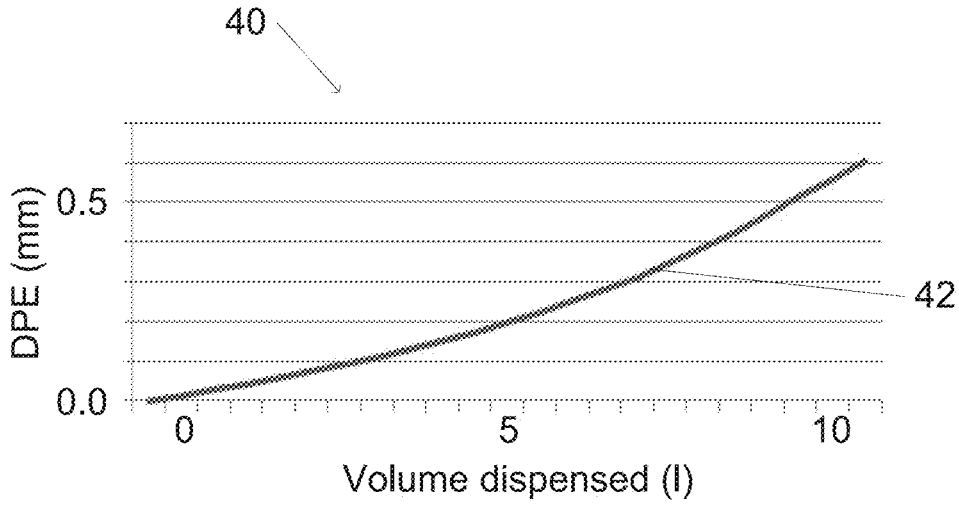
FIG. 3 shows a graph of an example of a functional relationship between a quantity of ink dispensed and dot placement error (DPE) for use in automated printing head alignment adjustment in accordance with an embodiment of the invention.

Automated printing head alignment adjustment in accordance with an embodiment of the present invention is based on a functional relationship between a cumulative quantity of ink that is dispensed by a printing head and a DPE for that printing head. The functional relationship may be related to a functional relationship between the cumulative quantity of ink that is dispensed by the printing head and an ink deposition velocity for that printing head FIG. 3 shows a graph of an example of a functional relationship between a quantity of ink dispensed and DPE for use in automated printing head alignment adjustment in accordance with an embodiment of the invention. Graph 40 shows an example of a functional dependence for a particular combination of printing head, ink, and printer. The DPE may be expressed as a distance between an intended drop deposition location and an actual drop deposition location (e.g. in units of millimeters). The DPE may represent a result of a measurement of a location on a substrate surface of a drop of ink that was deposited on that surface. For example, a measurement may be made by dispensing a drop of ink by a nozzle of a printing head when the printing head is located at a specific location relative to the substrate surface (e.g. a reference mark on the surface or an edge of the surface) and during a specific relative motion between the substrate and the printing head. The location of deposition of the dot on the substrate surface may be measured with respect to a reference location. For example, the reference location may represent a location on the surface on which an ink drop, or an average location of a plurality of ink drops, is deposited when the printing head is aligned (e.g. immediately following performance of an alignment procedure on the printing head).

Curve 42 illustrates an example of a functional relationship between DPE and a cumulative amount of ink (e.g. a volume of ink expressed in units of liters) dispensed by the printing head. For example, such a functional relationship may be obtained by analyzing results of a series of measurements. Such a series of measurements may include, for example, measuring DPE (e.g. by measuring the location of a drop of ink deposited on a substrate surface) at various points during the lifetime of a printing head after various volumes of ink have been dispensed. As another example, the DPE may be derived from an analysis of measurements of related quantities (e.g. a drop velocity).

The measurements may be performed on a plurality of printing heads, and the results statistically analyzed to yield a representative functional relationship. In the example illustrated by curve 42, if a printing head has dispensed 6 liters of ink, the DPE is greater than 0.2 millimeters. In a typical printing system, allowing such a DPE to remain uncorrected may adversely affect printing quality to an unacceptable degree.

As another example, the DPE in graph 40 may represent a predicted DPE. The predicted DPE may be based on a calculation of DPE. The calculation may be based on a measured functional relationship between an ink drop velocity and the cumulative amount of ink dispensed.

Figure 4:
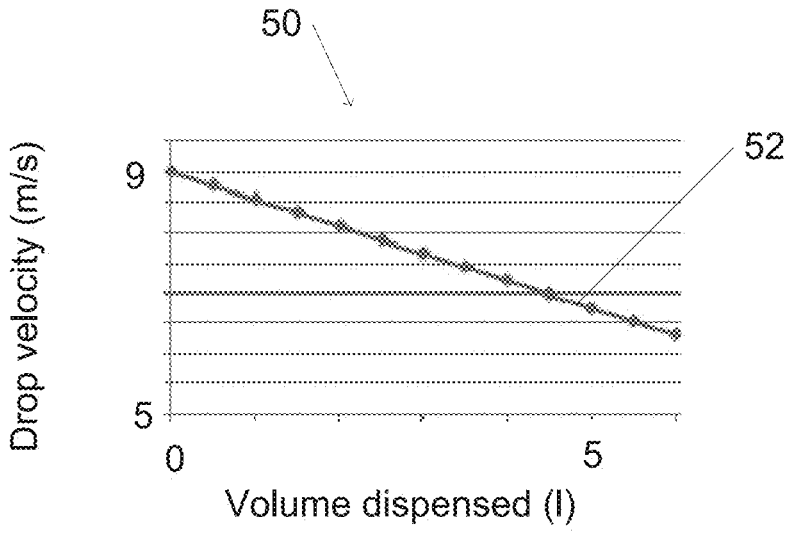
FIG. 4 shows a graph of an example of a functional relationship between ink drop velocity and a cumulative quantity of ink that is dispensed by a printing head that is subject to application of automated printing head alignment adjustment in accordance with an embodiment of the invention.

FIG. 4 shows a graph of an example of a functional relationship between ink drop velocity and a cumulative quantity of ink that is dispensed by a printing head that is subject to application of automated printing head alignment adjustment in accordance with an embodiment of the invention. Graph 50 shows an example of a relationship between drop velocity and a cumulative quantity of ink dispensed for a particular combination of printing head and ink. The ink deposition velocity, also referred to as the drop velocity, is expressed in graph 50 in units of meters per second. The cumulative quantity of ink dispensed is shown as a volume of ink and in units of liters.

Curve 52 indicates an example of an approximately linearly decreasing correlation between drop velocity and the volume of ink dispensed. In the example shown, the drop velocity for a newly installed printing head may be about 9 meters per second. After about 6 liters of ink have been dispensed, the drop velocity is reduced to less than 4 meters per second. Typically, DPE is inversely proportional to drop velocity.

Figure 5:
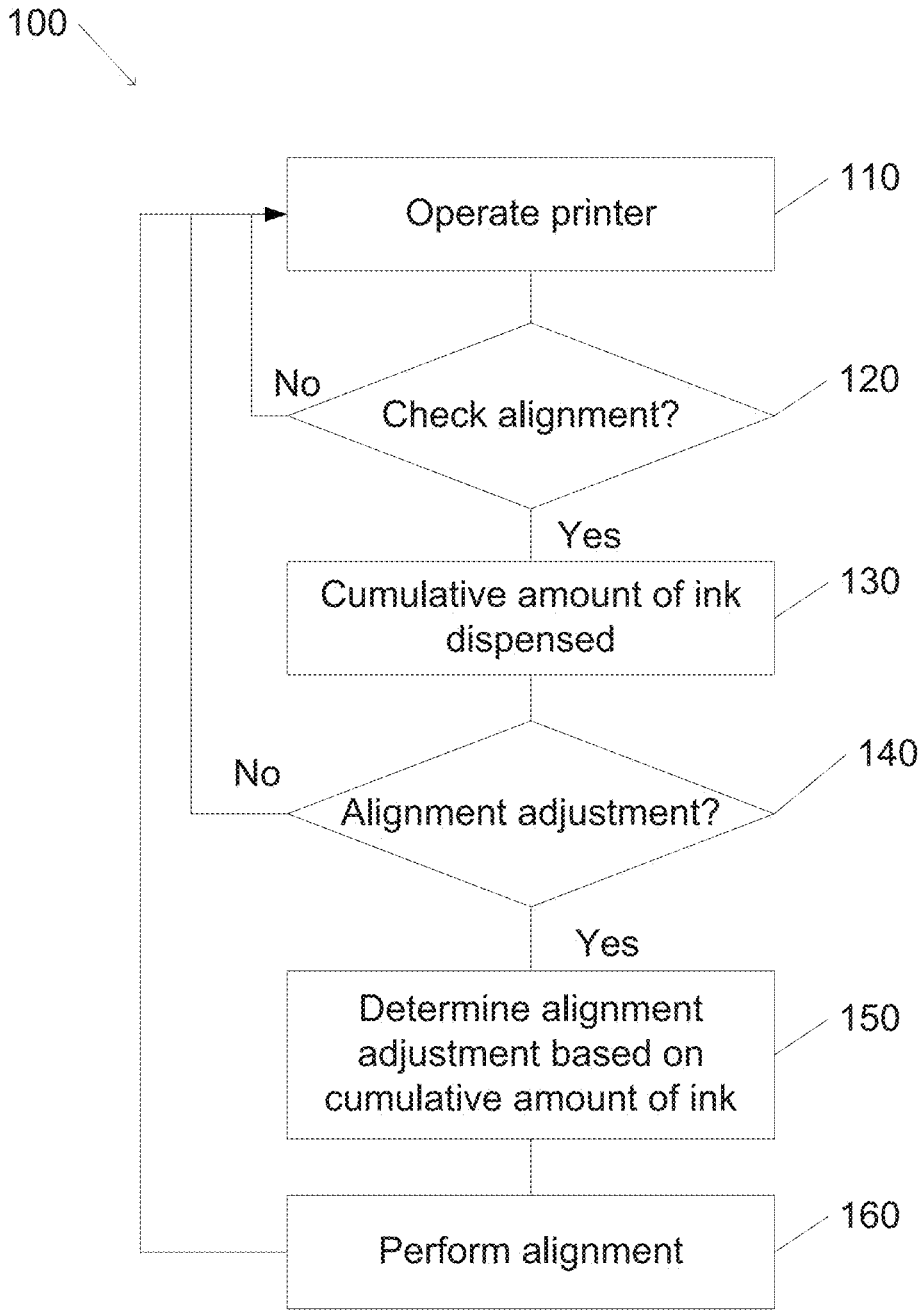
FIG. 5 is a flowchart of a method for automated printing head alignment adjustment in accordance with an embodiment of the invention.

FIG. 5 is a flowchart of a method for automated printing head alignment adjustment in accordance with an embodiment of the invention. Automated printing head alignment adjustment method 100 may be implemented by a processor that is associated with a printing system.

It should be understood that the illustration of the method in the form of a flowchart is for illustrative purposes only. Division of the method into discrete blocks is for convenience of the discussion only. Alternative division of the method into discrete blocks is possible with equivalent results. Such alternative division should be understood as included within the scope of embodiments of the invention. Similarly, unless stated otherwise, the order of the blocks has been selected for the convenience of the discussion only. Interchanging the order of blocks, or executing blocks concurrently, is possible with equivalent results. Such alternative ordering of the blocks should be understood as included within the scope of embodiments of the invention. The flowchart includes blocks that have been included for convenience of the discussion only. A method in accordance with an embodiment of the invention may be performed with those blocks omitted.

A printing system that implements automated printing head alignment adjustment method 100 may be operated (block 110). During operation of the printing system, a controller (e.g. incorporating, or incorporated into, a processor) that is associated with the printing system may control and monitor operation of the printing system. Controlling of the printing system may include causing a printing head of the system to dispense drops of ink (e.g. latex-based ink) for deposition on a substrate surface. Monitoring the printing system may include, for example, calculating or obtaining a time (or operating time) that has elapsed since the last time that printing head alignment was checked. As another example, monitoring the printing system may include counting a number of printing jobs that were executed, or a number of pixels printed, since the last time that printing head alignment was checked or installed.

A processor associated with the printing system may be programmed to automatically compare a monitored state of the printing system with a set of predetermined criteria. The comparison may determine whether or not the printing alignment of one or more printing heads is to be checked (block 120). For example, the predetermined criteria may indicate that the printing alignment is to be checked at predetermined time intervals (e.g. operating time or clock time), or after performing a predetermined number of operations (e.g. printing a predetermined number of pixels, or executing a predetermined number of printing jobs). The predetermined criteria may include separate criteria for each printing head of the printing system.

If comparison of the monitored state with the predetermined criteria indicates that alignment is not to be checked, the printing system may continue to operate (return to block 110).

If comparison of the monitored state with the predetermined criteria indicates that alignment of a printing head is to be checked, a processor that is associated with the printing system may proceed to check a current alignment status of the indicated printing head. For example, a printing system may be configured to perform the alignment check for all printing heads, or only for those printing heads indicated by the criteria (e.g. checking alignment only of those printing heads whose printing history indicates that alignment checking is appropriate).

Checking the alignment of a printing head of the printing system may include determining a cumulative amount of ink that was dispensed by that printing head (block 130). The cumulative amount of ink that was dispensed may be calculated or derived from results of one or more measurements. For example, the cumulative amount of ink may be derived from a sensed amount of ink that currently remains in an ink tank of the printing system (e.g. a volume of ink that remains in an ink tank). If the tank had been replaced or refilled one or more times since the associated printing head had been installed, a calculation of the cumulative amount of ink dispensed may include addition of stored data related to previous replacements or refilling of the ink tank (e.g. a volume of ink remaining in the tank prior to replacement or refilling). In some embodiments of the invention, determining the cumulative amount of ink dispensed may be calculated on the basis of data that is stored in a memory or data storage device associated with the printing system (e.g. of a count of a number or pixels that were printed by the printing head).

A processor associated with the printing system may determine whether or not an alignment adjustment is to be made (block 150). The cumulative amount of ink may be compared to one or more predetermined criteria for determining whether or not an alignment adjustment is to be made. For example, a lookup table or similar data structure may include a list of threshold values. Whenever, a value of the cumulative amount is obtained that exceeds a threshold value for the first time, alignment adjustment is to proceed. Once the alignment adjustment is performed, no further alignment adjustments are performed until the cumulative amount exceeds the next threshold of the list. In some embodiments of the invention, the predetermined criteria may include a magnitude of a change in the cumulative amount since the last time that an alignment adjustment was performed on the printing head.

In some embodiments of the invention, predetermined criteria for determining whether or not to perform alignment adjustment may be applied to quantity that is determined on the basis of the accumulated amount. Such quantities may include drop velocity, DPE, or a timing correction.

If it is determined that no alignment adjustment is to be performed, the printing system may continue to operate (return to block 110).

If it is determined that an alignment adjustment is to be performed, an alignment adjustment may be determined for the printing head based on the cumulative amount of ink (block 150). For example, an alignment adjustment (e.g. a change in printing head timing or synchronization) may be determined on the basis of a relationship between an alignment adjustment and the cumulative amount of ink dispensed. The relationship may be based, e.g., on previously performed measurements, on (either currently or previously performed) calculations, or on both. A representation of the relationship may be stored on a data storage or memory device that is associated with the printing system. For example, a data storage device may include a lookup table that associates values of the cumulative amount of ink dispensed (e.g. in units of volume, weight, or mass) with an alignment adjustment (e.g. an adjustment to a time that each ink drop is to be dispensed by a nozzle of the printing head). In some embodiments of the invention, a data storage device may include coefficients or parameters that define a functional relationship between the alignment adjustment and the cumulative amount of ink dispensed. For example, such a functional relationship may represent a timing adjustment (e.g. in seconds or fractions of seconds) as a polynomial function (or e.g., an exponential or series function) of the cumulative amount of ink dispensed.

In some embodiments of the invention, a relationship may determine the value of a factor that may be utilized in calculating the alignment adjustment. Such a factor may include a DPE, or a drop velocity.

A controller associated with the printing system may perform (implement) the determined alignment adjustment (block 160). An alignment adjustment typically includes adjusting a timing or synchronization between printing heads or nozzles of the printing head. For example, in order to compensate for a slower ink drop velocity, a printing head or nozzle may be instructed to dispense an ink drop earlier than it would be instructed to prior to the alignment adjustment.

After performance of the alignment adjustment, the printing system may continue to operate (return to block 110).

In accordance with an embodiment of the invention, a computer program application stored in non-volatile memory or computer-readable medium (e.g., register memory, processor cache, RAM, ROM, hard drive, flash memory, CD ROM, magnetic media, etc.) may include code or executable instructions that when executed may instruct or cause a controller or processor to perform methods discussed herein, such as a method for issuing and clearing alerts in a distributed computing system in accordance with an embodiment of the invention.

The computer-readable medium may be a non-transitory computer-readable media including all forms and types of memory and all computer-readable media except for a transitory, propagating signal. In one implementation, external memory may be the non-volatile memory or computer-readable medium.

While there have been shown and described fundamental novel features of the invention as applied to one or more embodiments, it will be understood that various omissions, substitutions, and changes in the form, detail, and operation of these embodiments may be made by those skilled in the art without departing from the spirit and scope of the invention. Substitutions of elements from one embodiment to another are also fully intended and contemplated. The invention is defined solely with regard to the claims appended hereto, and equivalents of the recitations therein.

We claim:

1. A method for automated alignment adjustment of a printing head, the method comprising performing an alignment adjustment on the printing head to compensate for a change in drop velocity based on a cumulative amount of ink that was dispensed by the printing head.

2. The method of claim 1, comprising obtaining the cumulative amount of ink from a count of a cumulative number of pixels that were printed by the printing head.

3. The method of claim 1, comprising obtaining the cumulative amount of ink from a sensed a quantity of ink in an ink tank that is configured to provide the ink to the printing head.

4. The method of claim 1, wherein performing the alignment adjustment comprises calculating an effect of the drop velocity on a predicted location on a substrate surface of a drop of ink that is dispensed by the printing head and deposited on the substrate surface.

5. The method of claim 1, wherein performing the alignment adjustment comprises comparing the cumulative amount of ink to a predetermined criterion.

6. The method of claim 1, wherein the alignment adjustment comprises adjusting timing of dispensing a drop of ink by the printing head.

7. The method of claim 1, wherein the ink is a latex-based ink.

8. A non-transitory computer readable medium having stored thereon instructions that when executed by a processor will cause the processor to perform the method of:

determining a cumulative amount of ink that was dispensed by the printing head;

performing an alignment adjustment on the printing head to compensate for a change in drop velocity based on a cumulative amount of ink that was dispensed by the printing head.

9. The computer readable medium of claim 8, wherein determining the cumulative amount of ink comprises counting of a cumulative number of pixels that were printed by the printing head.

10. The computer readable medium of claim 8, wherein determining the cumulative amount of ink comprises sensing a quantity of ink in an ink tank that is configured to provide the ink to the printing head.

11. The computer readable medium of claim 8, wherein performing the alignment adjustment comprises calculating an effect of the drop velocity on a predicted location on a substrate surface of a drop of ink that is dispensed by the printing head and deposited on the substrate surface.

12. The computer readable medium of claim 8, wherein performing the alignment adjustment comprises comparing the cumulative amount of ink to a predetermined criterion.

13. The computer readable medium of claim 8, adjusting timing of dispensing a drop of ink by the printing head.

14. The computer readable medium of claim 8, wherein the ink is a latex-based ink.

15. A printing system comprising:

a printing head for dispensing drops of ink for deposition on a substrate: and a controller for controlling operation of at least the printing head, the controller including a processor and a computer readable medium connected to the processor, wherein the computer readable medium contains at least a set of instructions to:

determine a current drop velocity for the printing head based on a cumulative amount of ink that was dispensed by the printing head;

perform an alignment adjustment on the printing head to compensate for a change in the drop velocity based on the current drop velocity.

16. The system of claim 15, wherein the printing head is configured to obtain ink for dispensing from an ink tank.

17. The system of claim 16, comprising a sensor for sensing a quantity of ink that remains in the ink tank.

18. The system of claim 15, wherein timing of dispensing of a drop of ink by the printing head is adjustable.

19. The system of claim 16, wherein the ink is a latex-based ink.

20. The system of claim 15, wherein the controller is configured to count a cumulative number of pixels that were printed by the printing head.

* * * * *